United States Patent [19]

Zebrowski et al.

[11] Patent Number: 4,588,209

[45] Date of Patent: May 13, 1986

[54] POWERFUL MAGNETIC FOLIO

[75] Inventors: Greg Zebrowski, Manhattan Beach; Ghanshyam H. Popat, Cucamonga, both of Calif.

[73] Assignee: Avery International Corporation, Pasadena, Calif.

[21] Appl. No.: 649,536

[22] Filed: Sep. 11, 1984

[51] Int. Cl.[4] ..... B42D 3/00; B42D 3/02

[52] U.S. Cl. ..... 281/45; 402/503; 24/303

[58] Field of Search ..... 281/45 A, 45, 1, 3; 402/503; 24/303

[56] References Cited

U.S. PATENT DOCUMENTS

| | | | |
|---|---|---|---|
| 2,693,370 | 11/1954 | Wheatley | 281/45 A |
| 2,784,757 | 3/1957 | Bosca et al. | 402/503 |
| 4,232,452 | 11/1980 | Dowzall et al. | 402/503 X |
| 4,255,837 | 3/1981 | Holtz | 24/303 X |

FOREIGN PATENT DOCUMENTS

| | | | |
|---|---|---|---|
| 1093104 | 2/1954 | France | 281/45 A |
| 1430950 | 1/1966 | France | 281/45 A |

*Primary Examiner*—Robert L. Spruill
*Assistant Examiner*—Taylor J. Ross
*Attorney, Agent, or Firm*—Poms, Smith, Lande & Rose

[57] ABSTRACT

A magnetic folio or notebook, capable of handling up to 40 or more sheets of paper, includes two notebook covers which are hingedly secured together, with a thin strip of permanent magnet material secured to one of the covers near the binding of the notebook. A second thin strip of magnetic material is mounted either on the other cover of the folio or notebook, or on a thin strip of flexible material, so that it may fold over on top of the first permanent magnet strip to hold a stack of papers between the two strips. The permanent magnet strips may be formed of ferrite material, with successive north and south poles along the length of the magnet strips from the top to the bottom of the notebook. The two mating magnet strips will have a corresponding pattern of magnet poles along their lengths, but with the north magnetization for one strip matching the south magnetization areas on the other strip, and similarly with the south magnetized areas of polarization of one strip matching the north pole areas of the other strip. Thin strips of magnetic material, such as cold-rolled steel, may extend along the back side of each of the permanently magnetized strips in order to enhance the holding properties of the opposed permanent magnet strips. Suitable adhesives may be employed to hold the magnet strips, the magnetic material, and the notebook or folio assemblies, together.

18 Claims, 6 Drawing Figures

FIG. 1.
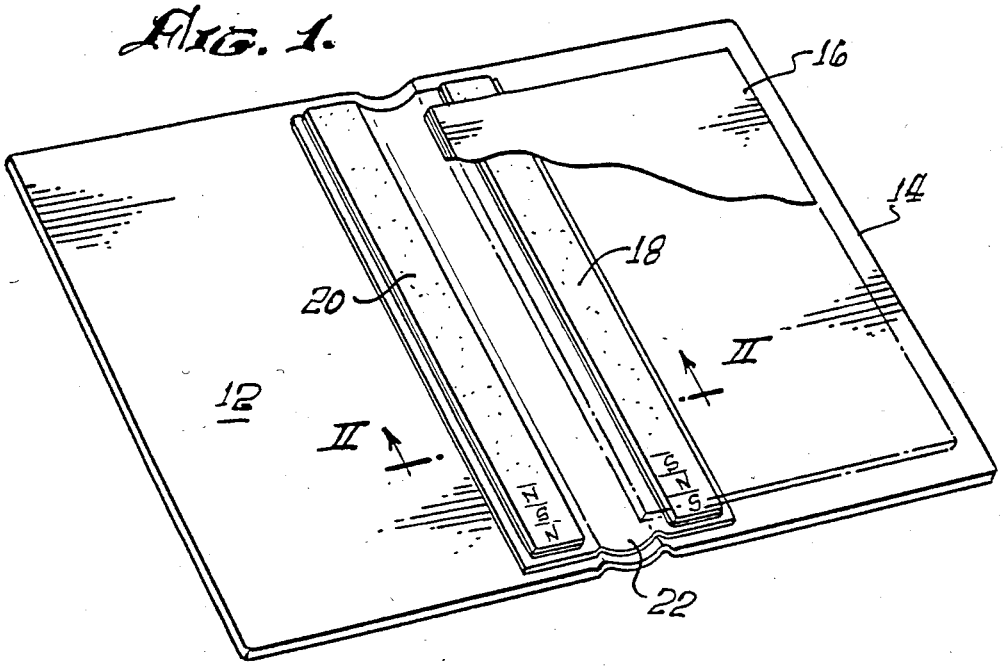
FIG. 2.
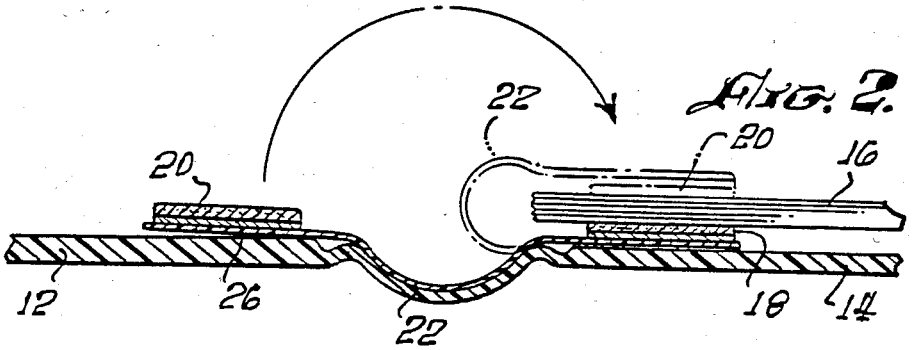
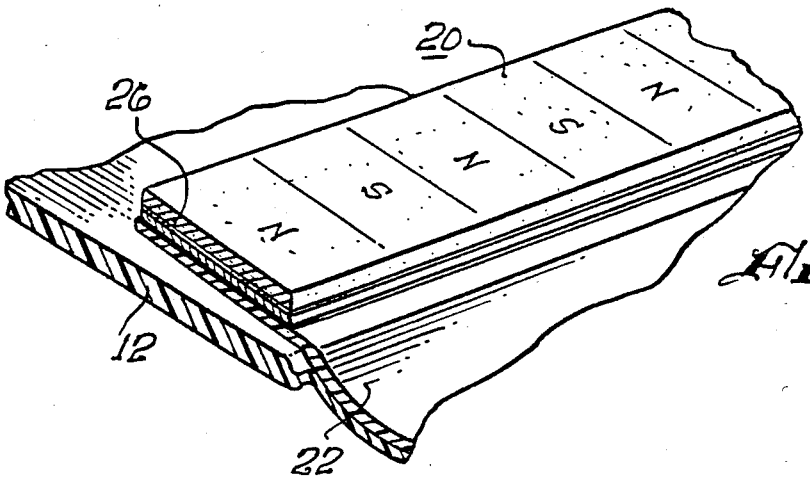
FIG. 3.

POWERFUL MAGNETIC FOLIO

FIELD OF THE INVENTION

This invention relates to notebooks or folios, and more particularly to magnetic notebooks or folios.

BACKGROUND OF THE INVENTION

It has previously been proposed to hold various objects together with magnets, and British Pat. No. 774,664, published May 15, 1974, shows a notebook wherein the outer edges of the notebook are held together with magnetic material. It has also been the practice heretofore to use magnets to hold single sheets of paper or the like in place, and this is commonly done on surfaces in the home or office where there are magnetic metallic surfaces such as the door or side of a refrigerator or cabinet available to cooperate with a strong permanent magnet. Similarly, a single sheet of paper is held in position under a permanent magnet and armature arrangement in British Pat. No. 1,182,480, published Feb. 25, 1970. However, it has not, up to the present, been proposed to hold a large number of plain sheets of paper, such as 20 or 40, for example, with magnetic holding arrangements, in a notebook or folio.

Accordingly, a principal object of the present invention is to provide a notebook or folio in which permanent magnet material is employed to hold a substantial number of sheets of paper in place within the notebook or folio.

SUMMARY OF THE INVENTION

In accordance with the present invention, a magnetic folio or notebook is provided with two elongated strips of permanently magnetized material, with one of these strips being mounted to the notebook inside one of the covers of the notebook, and the other strip of permanently magnetized material being mounted to pivot or hingedly extend over the first strip of permanent magnet material to securely hold a stack of sheets of paper within the notebook between the two permanently magnetized strips.

In accordance with another aspect of the invention, the second strip of permanently magnetized material may be separately mounted on a thin inner flexible strip so that the sheets of paper may be retained in position within the notebook at their inner edges, while the notebook is open and in use. Alternatively, one of the strips of magnetic material may be mounted on each of the two covers of the notebook or folio. In general, it is preferred that the magnet strips be mounted near the binding of the notebook, so that the papers may be reviewed while being held by the magnet strips.

An additional feature of the invention involves the use of thin strips of ferrite material which are magnetized along their length from the top to the bottom of the notebook or folio, with alternate north and south poles, on one strip, and matching south and north poles, respectively, on the other strip.

A supplemental feature of the invention includes the use of thin strips of magnetic material as a backing for each of the permamently magnetized strips, to thereby enhance the pull or holding power of the magnetic assembly.

Other objects, features and advantages of the invention will become apparent from a consideration of the following detailed description and from the accompanying drawings.

BRIEF DESCRIPTION OF THE DRAWINGS

FIG. 1 is an isometric view of a magnetic notebook or folio illustrating the principles of the present invention;

FIG. 2 is a cross-sectional view taken along lines II—II of FIG. 1;

FIG. 3 is an enlarged end view showing one of the permanent magnet strips which is mounted for rotation independent of the covers of the folio;

DETAILED DESCRIPTION

Figure 4:
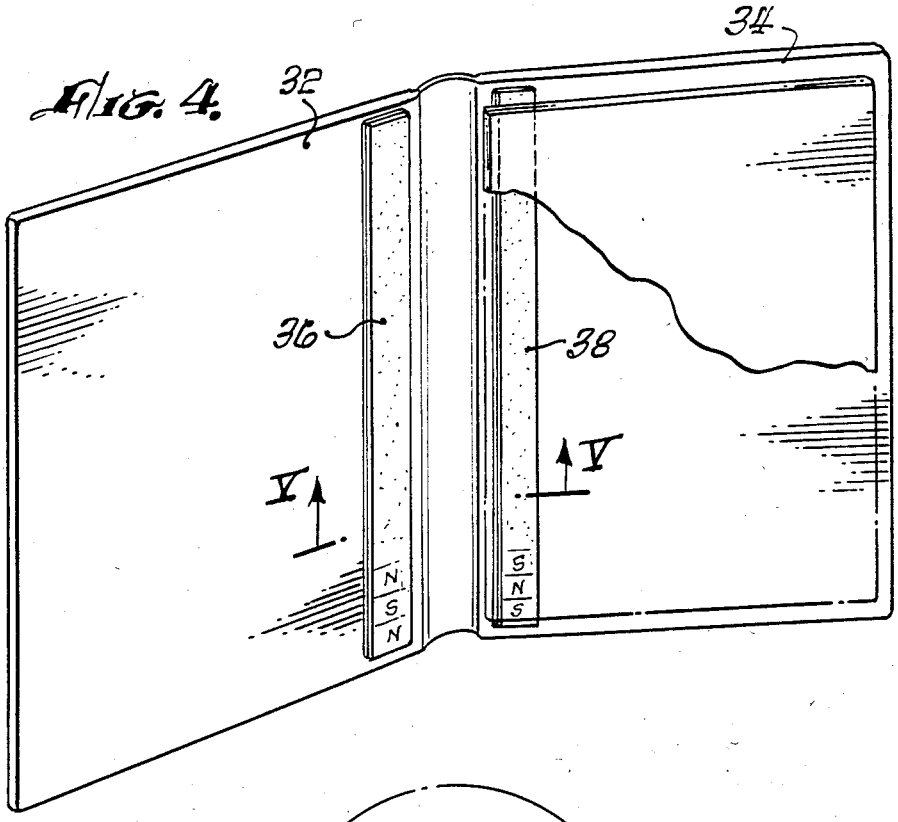
FIG. 4 is another embodiment illustrating the principles of the inventon.

Referring more particularly to the drawings, FIG. 1 shows a magnetic folio or notebook including two covers 12 and 14 wherein a stack of paper 16 is held between the magnet strips 18 and 20. The stack of sheets of paper 16 may include, for example, perhaps 10 or 20 up to 30 or 40 or more sheets of papers and may be in the order of 3/16ths of an inch in thickness, and still be securely held against release by the magnets 18 and 20. As shown in FIGS. 2 and 3 to advantage, the permanent magnet strip 20 may be mounted on a flexible strip 22, while the magnet strip 18 may be secured by adhesive to the right-hand edge of the strip 22 which may in turn be held by adhesive or glue to the right-hand cover 14 of the magnetic folio or notebook. FIG. 2 has a particularly good showing of how the notebook covers 12 and 14 may be opened on a desk or the like, and the sheets of paper 16 may still be positively held in their proper location by the permanent magnet strips 18 and 20. FIGS. 1 and 3, on the other hand, show the magnetic strip 20 folded back to the left so that individual sheets of paper from the stack 16 may be added or deleted.

The magnetic strips 18 and 20 are specially magnetized in order to increase their holding power and magnetic strength. More specifically, as shown in FIGS. 1 and 3, the magnetic strips are magnetized with alternate north and south poles at their exposed surfaces, and with the north poles on one strip being opposite the south poles on the other strip, and vice versa. In addition, to further enhance the holding power and magnetic pull of the strips 18 and 20, thin additional strips of magnetic material 26 and 28 are bonded by adhesive or the like tightly to the permanently magnetized strips. The strips 26 and 28 may be coexensive with the permanent magnet strips, and may be formed of cold rolled steel, for example. The addition of these strips has the effect of increasing the magnetic pull or holding power of the permanent magnet strips by about 10 percent or more.

Figure 5:
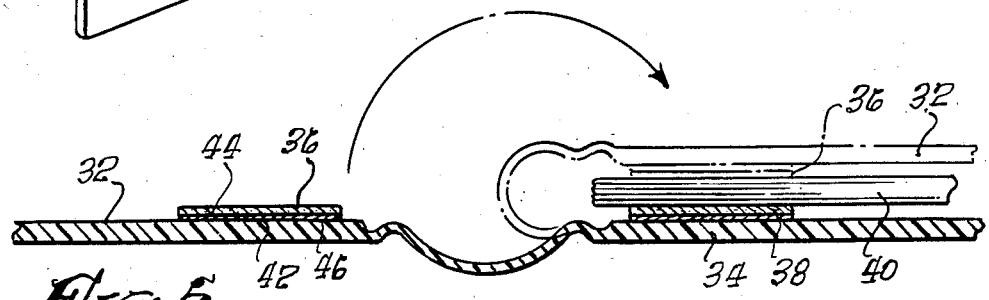
FIG. 5 is a cross-sectional view taken along lines V—V of FIG. 4, and indicating diagrammatically the closure of the notebook.
Figure 6:
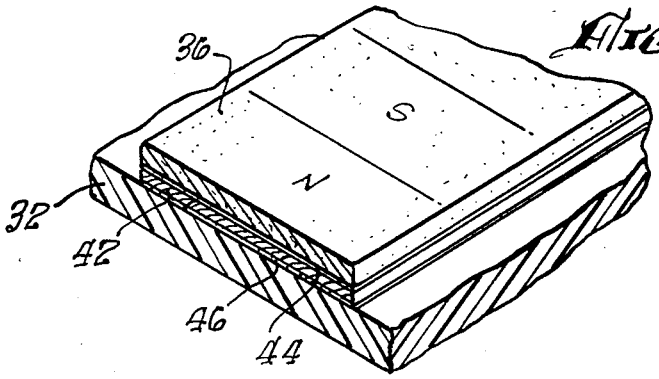
FIG. 6 is a partial cross-sectional view showing the assembly of one of the magnet strips with other elements of the magnetic notebook assembly.

FIG. 4 shows an alternative embodiment of the invention in which the magnetic notebook or folio includes two covers 32 and 34 and two magnetic strip assemblies 36 and 38, but with both of the two magnet assemblies 36 and 38 being secured to the covers 32 and 34 of the notebook, so that, as the notebook is opened, the sheets of paper 40 are automatically released, and may be shifted, removed, or inserted, as desired, as long as the notebook is open. However, as the notebook is closed, as indicated toward the right in FIG. 5, the sheets of paper 40 are held firmly in position by the magnet assemblies 36 and 38. As in the case of the embodiment of FIGS. 1 through 3, the permanent magnet assemblies include the magnetic backing plate or strip 42, as shown to advantage in FIG. 6, and the strip 42 which may be made of cold rolled steel is again secured to the permanent magnet strip 36 by a suitable very thin layer of adhesive 44, and a similar layer of adhesive 46 is employed to secure the strip 42 to the cover 32 of the notebook.

For completeness, details will now be given as to the dimensions and type of materials employed in the fabrication of one embodiment illustrating the principles of the invention. The magnetic strips which were employed were 10 inches long by 1 inch wide by 60 mils thick, and were moderately flexible. They were purchased from Elektro-Physik, Inc., 1147 Independence Boulevard, Virginia Beach, Va. 23455. They were made of "high energy" permanent magnet ferrite material. The strips were magnetized from one surface thereof with alternate north and south poles, about every half an inch. The magnetic material which was adhered to the back of each of the permanent magent strips was cold rolled steel having a thickness of 30 mils. An acrylic based adhesive was employed both for bonding the permanent magnet strip material to the cold rolled steel strips, and also to secure the cold rolled steel strips to the vinyl material employed both as a cover for the notebook or folio, or for the flexible strip 22 employed for mounting the magnetic strip 20 in the embodiment of FIGS. 1 through 3. The adhesive layers are normally less than one thousandth of an inch thick, when bonding two flat surfaces. Concerning other dimensions, in one a successful prototype which was constructed, the loose-leaf binder or folio was approximately $11\frac{3}{4}$ or 12 inches tall, and nearly 9 inches wide in order to accommodate $8\frac{1}{2}\times 11$ inch paper sheets. Of course, with legal or other size paper, it would be expected that the size of the binder, and the corresponding size of the magnet assemblies would vary. As mentioned above, with the notebook being approximately $9\times 12$ inches in size, magnetic strips which were 10 inch$\times$1 inch were employed. These strips could, of course, be narrower or broader, depending on the desired strength or holding power for the magnet, and could range, for example, from about $\frac{1}{4}$ inch up to two or several inches wide. It would normally be expected that the length of the magnets would also vary from about 4 inches to about 15 inches. In addition, the thickness of the magnet could vary from about five thousandths of an inch (0.005 inch) up to about $\frac{1}{4}$ inch in thickness. However, the preferred range of thickness in order to obtain adequate holding strength without undue thickness for the notebook is in the order of about 0.020 inch up to about 0.150 inch.

Concerning the thickness of the cold rolled steel element 26 and 28, as mentioned above, the succesful prototype used strips which were about 0.030 inch thick. However, somewhat greater or somewhat less thicknesses of cold rolled steel or other appropriate magnetic material may be employed, for example, from about 0.005 inch to about 0.075 inch thick, and still realize substantial increases in the holding power and strength of the associated permanent magnet strips.

In conclusion, it is to be understood that the foregoing detailed description and the accompanying drawings relate to illustrative embodiments of the invention. Various modifications may be made within the scope of the invention. Thus, by way of example, and not of limitation, both of the two permanent magnet strips may be pivotally mounted relative to one another by a mechanical hinge, or by a cloth strip, as well as by the vinyl strip 22 employed for mounting one of the magnet strips as shown in FIG. 1. In addition, instead of using a single strip of magnetic material on each side, two thinner magnetic strips may be employed on each side and secured to or associated with the two covers of the notebook or folio. Similarly, instead of a single long magnet strip assembly on each side, such as the magnet strips 18 and 20, two shorter magnetic assemblies may be employed on each side. Also, the covers of the magnetic folio or notebook may be recessed, or reduced in thickness somewhat in the area of said magnetic assemblies so that the overall thickness of the notebook is not greatly increased by the addition of the magnetic assemblies. Accordingly, the present invention is not limited to that precisely as shown in the drawings and as described hereinabove.

What is claimed is:

1. A magnetic folio or notebook comprising:

first and second notebook covers hingedly secured together at a central binding;

a thin strip of permanent magnet material mounted on one of said covers near said binding;

a second thin strip of permanently magnetized material;

means for mounting said second strip of permanent magnet material for pivotal movement to overlie said first strip to enclose and clamp 20 or more sheets of paper between the two magnet strips; and said first magnet strip having a series of alternate north and south pole areas along its surface extending from one end to the other of said magnet strip, with each north and each south pole area extending substantially all of the way across the transverse width of said magnet strip, and with the extend of said areas in one direction being not more than twice the extent thereof in the perpendicular direction;

and said second magnet strip having a corresponding set of opposed series of south and north pole areas along its length, with the south poles matching the north poles of the first strip, and the north poles of said second strip matching the south poles of said first strip, whereby more than thirty sheets of plain paper are normally held between said magnet strips, and sheets may be easily added or removed by pivoting said magnet strips apart.

2. A magnetic folio or notebook as defined in claim 1 wherein said two magnetic strips are secured to the respective covers of the notebook.

3. A magnetic folio or notebook as defined in claim 1 wherein said second magnet strip is hingedly mounted on said notebook to rotate or pivot separate from either of said covers, whereby paper sheets may be held securely in place when the notebook covers are open.

4. A magnetic folio or notebook as defined in claim 1 wherein said permanent magnet strip is between 0.020 inch and 0.150 inch thick, and between one quarter and two inches wide.

5. A magnetic folio or notebook as defined in claim 1 wherein a thin strip of magnetic material is adhesively secured to the back side of each of said magnet strips to increase the magnetic pull.

6. A magnetic folio or notebook as defined in claim 5, wherein each said thin strip of magnetic material is generally coextensive with the permanent magnet strip with which it is associated and has a thickness between 0.005 inch and 0.075 inch.

7. A magnetic folio or notebook comprising:

first and second notebook covers hingedly secured together at a central binding;

a first thin strip of permanent magnet material mounted in said notebook at one of said covers near the notebook binding;

a second thin strip of permanently magnetized material;

means for mounting said second strip of permanent magnet material for pivotal movement to overlie said first strip to enclose and clamp 10 or more sheets of paper between the two permanent magnet strips;

thin strips of magnetic material adhesively secured to the back side of said magnet strips to increase the magnetic pull;

said first magnet strip having a series of alternate north and south pole areas along its surface extending from one end to the other of said magnet strip, with each north and each south pole area extending substantially all of the way across the transverse width of said magnet strip, and with the extent of said areas in one direction being not more than twice the extent thereof in the perpendicular direction;

and said second magnet strip having a corresponding set of opposed series of south and north poles areas along its length, with the south poles matching the north poles of the first strip, and the north poles of said second strip matching the south poles of said first strip, at least twenty-five sheets of plain paper mounted in said notebook or folio and held firmly in place between said strips of magnetic material;

whereby sheets of paper are normally held between said magnet strips, and sheets may be easily added or removed by pivoting said magnet strips apart.

8. A magnetic folio or notebook as defined in claim 7 wherein the two magnetic strip assemblies are secured to the respective covers of the notebook.

9. A magnetic folio or notebook as defined in claim 7 wherein one of the magnet strip assemblies is hingedly mounted on said notebook to rotate or pivot separate from either of said covers, whereby paper sheets may be held securely in place when the notebook covers are open.

10. A magnetic folio or notebook as defined in claim 7 wherein said permanent magnet strip is between 0.020 inch and 0.150 inch thick, and between one quarter and two inches wide.

11. A magnetic folio or notebook as defined in claim 7, wherein each said thin strip of magnetic material is generally coextensive with the permanent magnet strip with which it is associated and has a thickness between 0.005 inch and 0.075 inch.

12. A magnetic folio or notebook comprising:

first and second notebook covers hingedly secured together at a central binding;

a thin strip of permanent magnet material mounted in said notebook at one of said covers near the notebook binding;

a second thin strip of permanently magnetized material;

means for mounting said second strip of permanent magnet material for pivotal movement to overlie said first strip to enclose and clamp 20 or more sheets of paper between the two magnet strips;

said first magnet strip having a series of north and south poles along its surface extending from the top to the bottom of said notebook; and said second magnet strip has a corresponding set of opposed series of south and north poles along its length, with the south poles matching the north poles of the first strip, and the north poles of said second strip matching the south poles of said first strip;

said north and south poles extending substantially across the transverse extent of said strips, and having substantially comparable extent in the transverse and longitudinal directions; and whereby sheets of paper are normally held between said magnet strips, and sheets may be easily added or removed by pivoting said magnet strips apart.

13. A magnetic folio or notebook as defined in claim 12 wherein said two magnetic strips are secured to the respective covers of the notebook.

14. A magnetic folio or notebook as defined in claim 12 wherein said second magnet strip is hingedly mounted on said notebook to rotate or pivot separate from either of said covers, whereby paper sheets may be held securely in place when the notebook covers are open.

15. A magnetic folio or notebook as defined in claim 12 wherein a thin strip of magentic material is adhesively secured to the back side of each of said magnet strips to increase the magnetic pull.

16. A magnetic folio or notebook as defined in claim 12 wherein said permanent magnet strip is between 0.020 inch and 0.150 inch thick, and between one quarter and two inches wide.

17. A magnetic folio or notebook as defined in claim 12, wherein each said thin strip of magnetic material is generally coextensive with the permanent magnet strip with which it is associated and has a thickness between 0.005 inch and 0.075 inch.

18. A magnetic folio or notebook comprising:

first and second notebook covers, each of said notebook covers having four edges;

binding means for flexibly securing said covers together along one edge of each of said covers;

a thin strip of permanent magnet material mounted in said notebook along one of the edges of one of the covers of said notebook;

a second thin strip of permanent magnetic material;

means for mounting said second strip of permanent magnet material of pivotal movement to overlie said first strip to enclose and clamp 20 or more sheets of paper between the two magnet strips;

said first magnet strip having a series of north and south poles along its surface extending from one end to the other of said magnet strip; said second magnet strip has a corresponding set of opposed series of south and north poles along its length, with the south poles matching the north poles of the first strip, and the north poles of said second strip matching the south poles of said first strip;

said north and south poles extending substantially across the transverse extent of said strips, and having substantially comparable extent in the transverse and longitudinal directions; and thin strips of magnetic material secured in tight engagement to the back side of each said strip of permanently magnet material to increase the magnetic pull;

whereby sheets of paper are normally held between said magnet strips, and sheets may be easily added or removed by pivoting said magnet strips apart.

* * * * *